US005934707A

United States Patent [19]

Johnson

[11] Patent Number: 5,934,707

[45] Date of Patent: Aug. 10, 1999

[54] MESSAGE CALENDAR

[76] Inventor: Joyce W. Johnson, P.O. Box 96, Lynch Station, Va. 24571

[21] Appl. No.: 08/866,327

[22] Filed: May 30, 1997

[51] Int. Cl.[6] ..... B42D 5/04

[52] U.S. Cl. ..... 283/2; 283/56; 283/117; D19/20; D19/24; D19/25; 40/110; 434/304

[58] Field of Search ..... 283/24, 56, 117; D19/20, 24, 25; 40/110; 434/304, 365, 128; 702/178; D10/3; 345/963; 368/28

[56] References Cited

U.S. PATENT DOCUMENTS

| | | | |
|---|---|---|---|
| 50,430 | 10/1865 | Gibson . | |
| D. 172,317 | 5/1954 | Shellman . | |
| D. 246,048 | 10/1977 | Damman | D19/3 |
| D. 249,649 | 9/1978 | Ohtani . | |
| D. 259,001 | 4/1981 | Mullaney | D6/97 |
| D. 260,374 | 8/1981 | Umanoff . | |
| D. 320,564 | 10/1991 | Sharkey . | |
| D. 347,178 | 5/1994 | Taphorn . | |
| 432,838 | 7/1890 | Robinson . | |
| 1,018,641 | 2/1912 | Strayer . | |
| 1,556,354 | 10/1925 | Rogers . | |
| 2,831,278 | 4/1958 | Myers . | |
| 4,234,187 | 11/1980 | Las | 273/248 |
| 4,525,943 | 7/1985 | Iwata | 40/110 |
| 4,556,390 | 12/1985 | Rahn et al. | 434/433 |
| 4,639,226 | 1/1987 | Rahn et al. | 434/433 |
| 4,709,493 | 12/1987 | Sapp . | |
| 4,947,564 | 8/1990 | Reece et al. | 40/110 |
| 4,975,061 | 12/1990 | Avrill | 434/304 |
| 5,090,733 | 2/1992 | Bussiere | 283/2 |
| 5,106,122 | 4/1992 | Perelman | 283/2 |
| 5,125,688 | 6/1992 | Bianco | 283/2 |
| 5,257,940 | 11/1993 | Schaarschmidt | 434/304 |
| 5,261,173 | 11/1993 | Brobeck | 40/110 |
| 5,412,886 | 5/1995 | Quinn | 283/2 |
| 5,443,288 | 8/1995 | Miles | 283/2 |
| 5,651,677 | 7/1997 | Hildebrandt | 434/99 |
| 5,654,940 | 8/1997 | Wei | 368/28 |
| 5,660,389 | 8/1997 | Freda, III | 273/249 |
| 5,661,918 | 9/1997 | Malcolm etal. | 40/107 |
| 5,690,364 | 11/1997 | Oleske et al. | 283/2 |
| 5,799,423 | 9/1998 | Malino | 40/107 |

*Primary Examiner*—Frances Han

[57] ABSTRACT

A message calendar for suggesting engaging in specified activities on a selected day in the future. The calendar has a main panel bearing indicia corresponding to all days and months of a calendar year. Masks are removably placed on the calendar to indicate a selected activity and a selected day. Each mask is configured to bear a pictorial device symbolic of the intended activity. Each mask has an opening for revealing indicia corresponding to the selected day and for concealing indicia corresponding to adjacent days. Additionally, removably adhered members bearing messages rendered in written languages may be adhered to further comment on proposed activities. The calendar includes a clock face having movable hands and an area devoid of indicia for storing masks and members bearing written messages by adherence.

1 Claim, 2 Drawing Sheets

MESSAGE CALENDAR

BACKGROUND OF THE INVENTION

1. Field of the Invention

The present invention relates to calendars, and more particularly to a calendar having features facilitating person-to-person communication. The novel calendar includes self-adhering, removable masks and messages which relate to future and upcoming dates and times.

2. Description of the Prior Art

Calendars, in their basic form, provide written tables displaying days and months of the future. Many calendars are provided with a modicum of space surrounding indicia corresponding to each day, which space is available for writing of notes which will serve the writer or others as a reminder or other advisement of future events, obligations, and the like.

U.S. Pat. No. 4,709,493, issued to Charles E. Sapp on Dec. 1, 1987, describes a calendar adapted to display personalized messages. The messages are personalized in that the user of Sapp's calendar inscribes one or more personal message on a roll of paper which then is scrolled past windows formed in a panel covering the roll of paper. By contrast, the present invention provides prewritten messages which are placed over the calendar. Each message bearing member has a window generally corresponding in area to indicia corresponding to a date. This member, or mask, is placed over indicia corresponding to a selected date. The prewritten message is then understood to relate to the date revealed by the window in the mask. The device of Sapp lacks prewritten messages and masks superimposed over date indicating indicia.

Although some prior art devices combine a clock and calendar, as exemplified in U.S. Design Pat. No. 320,564, issued to John F. Sharkey on Oct. 8, 1991, such devices report projected time and dates. They are not employed in the novel manner to draw attention to a particular date and time, and to propose an activity on the selected date and time.

None of the above inventions and patents, taken either singly or in combination, is seen to describe the instant invention as claimed.

SUMMARY OF THE INVENTION

The present invention provides a medium of non-verbal, personal communication for proposing future activities and for conveying personal sentiments a propos of proposed and past activities. The apparatus includes a calendar displaying all days of a selected period of time, such as a year. A list of holidays may be included to be used with the calendar. A plurality of masks are provided for use with the calendar. Each mask bears a pictorial symbol of an activity which is to be associated with a particular day. A particular mask is selected and placed over the calendar so that a window formed in the mask exposes indicia corresponding to a particular date. A clock face is disposed proximate the calendar, for indicating a preferred time for the suggested activity to occur. Additional information conveying members bearing messages reflecting sentiments responsive to messages or to the proposed activity may be posted by placing one or more information conveying members on the calendar.

Each mask and information conveying member is provided with removable attachment apparatus, such as magnets, hook and loop material, and non-setting, permanently tacky adhesives. The calendar has a magnetically responsive, complementary hook and loop, or smooth surface, as appropriate for cooperating with the attachment apparatus. Idle masks and information conveying members are stored on a blank section of the calendar, and may be removed and strategically placed on the calendar as desired.

In a preferred embodiment of the invention, the symbols and messages of the masks and information conveying members are thematically linked, so that a brief dialog on a selected subject may be accomplished by use of the novel calendar.

Accordingly, it is a principal object of the invention to provide a personal message calendar having a calendar displaying indicia corresponding to future dates, and members removably attachable to the calendar for conveying suggestions for future activities.

It is another object of the invention that the novel calendar have apparatus for conveying messages expressing sentiments related to the suggested activities.

It is a further object of the invention that the calendar have a clock face for indicating a preferred time for an activity suggested by a mask.

Still another object of the invention is that suggestions for activities and sentiments related to the suggested activities be thematically linked to the subject activities by symbolic pictorial representation.

An additional object of the invention is that suggestions for activities be symbolically set forth by the mask, rather than expressed in the form of written words.

It is again an object of the invention to express human emotions regarding proposed activities in non-verbal form.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
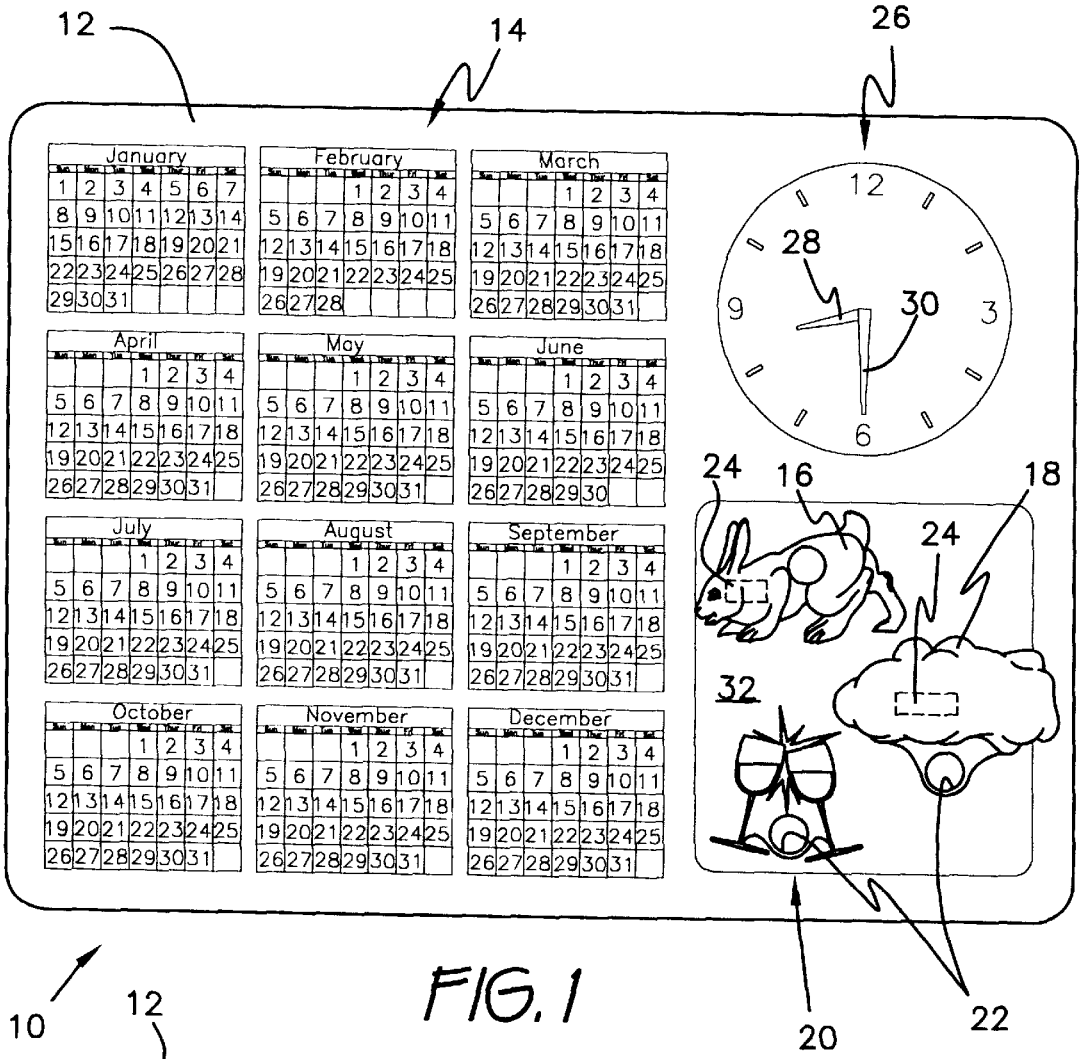
FIG. 1 is a front elevational view of the invention, with some removable elements removed for clarity.

Turning now to FIG. 1 of the drawings, novel message calendar 10 is seen to have a principal panel 12 bearing date indicia 14 corresponding to sequentially numbered days of a month, and a plurality of masks 16, 18, 20. Preferably, calendar 10 encompasses all days of a calendar year, divided into the twelve months in generally conventional fashion.

A mask, generally, is a device which may be removably placed on panel 12 so as to reveal indicia 14 corresponding to one day of a month and to conceal adjacent and contiguous indicia 14, so that a selected date is prominently and clearly indicated to an observer. More specifically, each mask 16, 18, or 20 bears a pictorial device configured to evoke a symbol of one of a human activity and a human sentiment. Mask 16, 18, or 20 has an opening 22 dimensioned and configured to reveal date indicia 14 corresponding to one day of the month and to conceal adjacent and contiguous date indicia 14. Placement of a mask 16, 18, or 20 expresses a desire of a person to indicate a suggested day to engage in the activity symbolized by mask 16, 18, or 20.

A mask 16, 18, or 20 also has means for removably adhering to principal panel 12. Adherence may be magnetic, by hook and loop material (not shown), by non-hardening adhesive (not shown), by interlocking members (not shown) such as snap connectors, or in any other suitable way. Preferably, adherence is provided by magnets 24 embedded individually within each mask 16, 18, or 20. If provided, snap connectors comprise miniature projections disposed upon one of the masks 16, 18, and 20 and principal panel, and sockets cooperating with projections disposed upon the other one of the masks 16, 18, 20 and principal panel 12.

Panel 12 bears not only indicia 14 but also has a time display for annunciating a preferred time of the day indicated by a mask 16, 18, or 20 for engaging in the activity symbolized thereby. Preferably, the time display is passive, in that it does not move to reflect passing time. Rather, it is resettable to different times, and will continue to display a set time until reset in a subsequent usage. A preferred time display is clock face 26, having movable hands 28, 30.

Panel 12 has a frontal surface area 32 devoid of date indicia 14. This area is of significant area configured to accommodate temporary storage of masks 16, 18, 20 by adhering masks 16, 18, 20 thereto.

Figure 2:
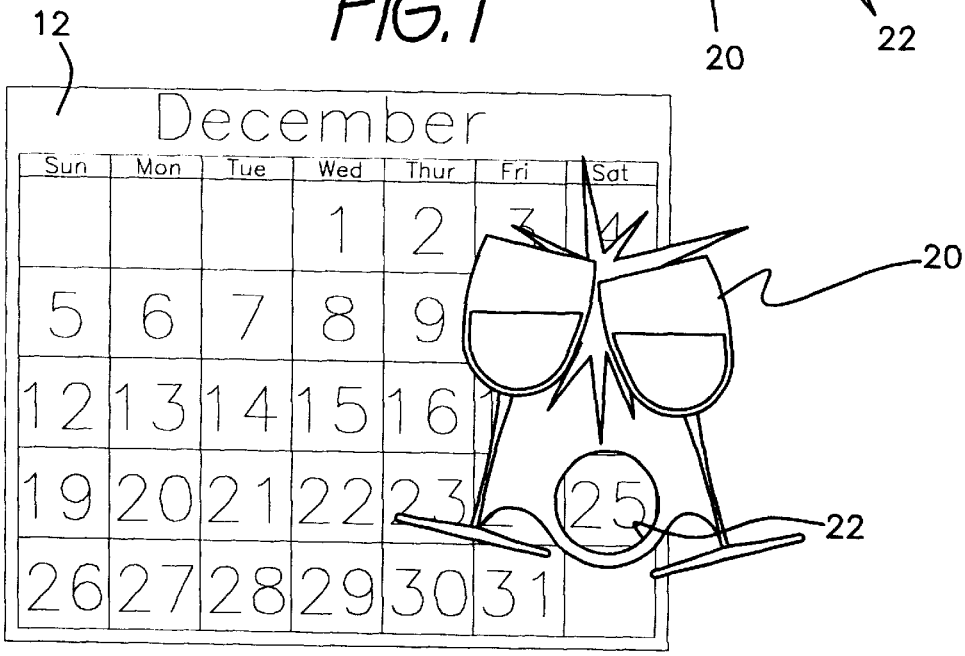
FIG. 2 is a front elevational detail view of FIG. 1, illustrating operable placement of one movable element.

FIG. 2 illustrates representative use of a mask 20. Mask 20 is placed over panel 12 such that indicia 14 corresponding to a selected date is revealed in opening 22. A mask 16, 18, or 20 is selected for conveying a desired message according to its pictorial representation.

Figure 3:
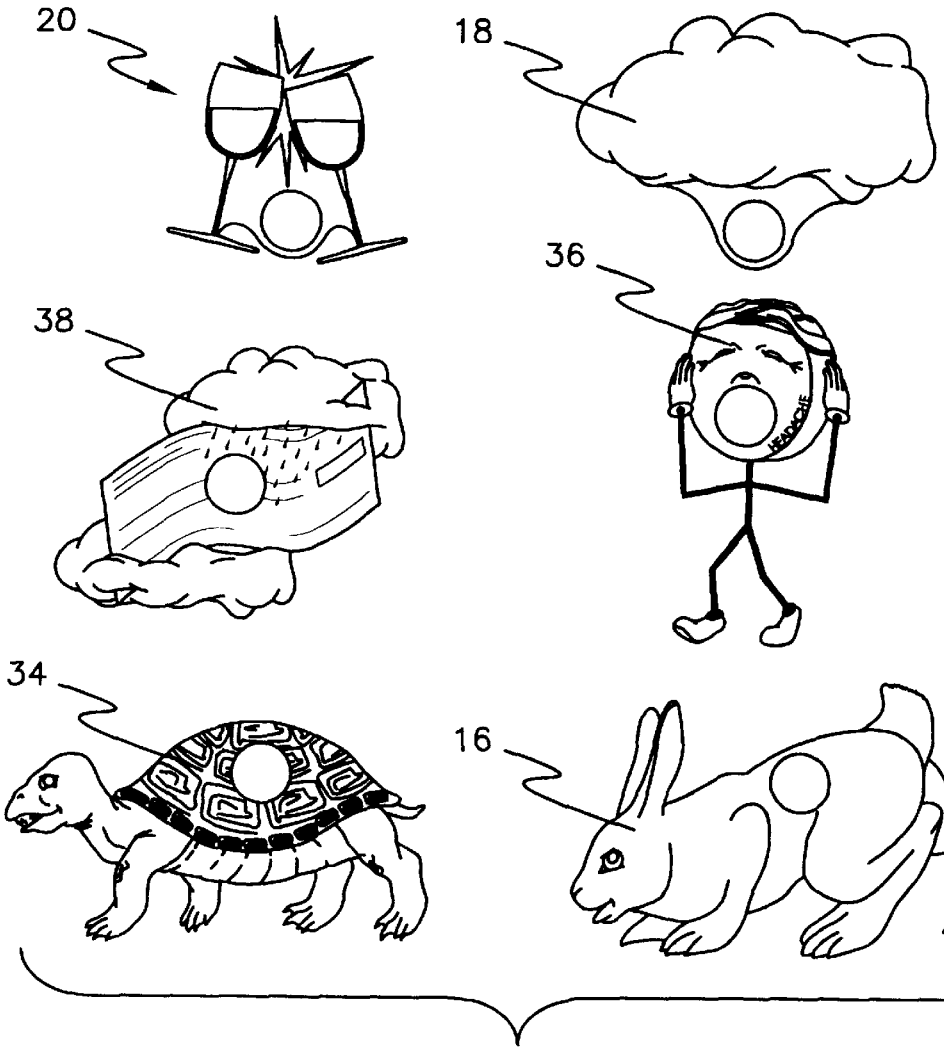
FIG. 3 shows various symbols that may be used as moveable elements.

As seen in FIG. 3, a plurality of masks 16, 18, 20, 34, 36, and 38 are provided. Any one may be employed in the manner described for use of any other. Each mask 16, 18, 20, 34, 36, or 38 bears a pictorial representation of a theme indicative of an activity which is to be suggested by use of calendar 10. Pictorial representation encompasses indicia borne by the mask 16, 18, 20, 34, 36, or 38, or by molding mask 16, 18, 20, 34, 36, or 38 to simulate the intended pictorial representation, or both indicia and molding.

Although the present invention may be employed to facilitate non-verbal communication in any field of endeavor or any aspect of life, it will be illustrated by the example of sexual, romantic, and related activities and sentiments. It may that direct reference to and inquiry about sexual and romantic preferences will be taken as unduly confrontational, direct, or embarrassing, so that indirect communication is preferred. To enable frequently encountered situations regarding querying as to desires and preferences, masks 16, 18, 20, 34, 36, and 38 are provided with predetermined thematic representations related to frequently encountered questions which must be resolved.

For example, mask 16, by virtue of simulating a rabbit, suggests an activity, such as a sexual encounter, which is to be conducted expeditiously. As an alternative, mask 34 bears a pictorial representation of a turtle, for suggesting an activity, such as a sexual encounter, be conducted at a prolonged and leisurely pace.

A suggested activity may be responded to by placement of a superseding mask 16, 18, 20, 34, 36, or 38. For example, mask 36 bearing a pictorial representation of an analgesic medicament may be placed on panel 12 in place of and as a response to mask 16 or 34, for expressing a desire to defer a suggested activity due to incapacitation by physiological distress.

Mask 20, bearing a pictorial representation of wine glasses being raised in a toast, may be mounted on panel 12 for expressing a desire to engage in a celebratory activity.

Figure 4:
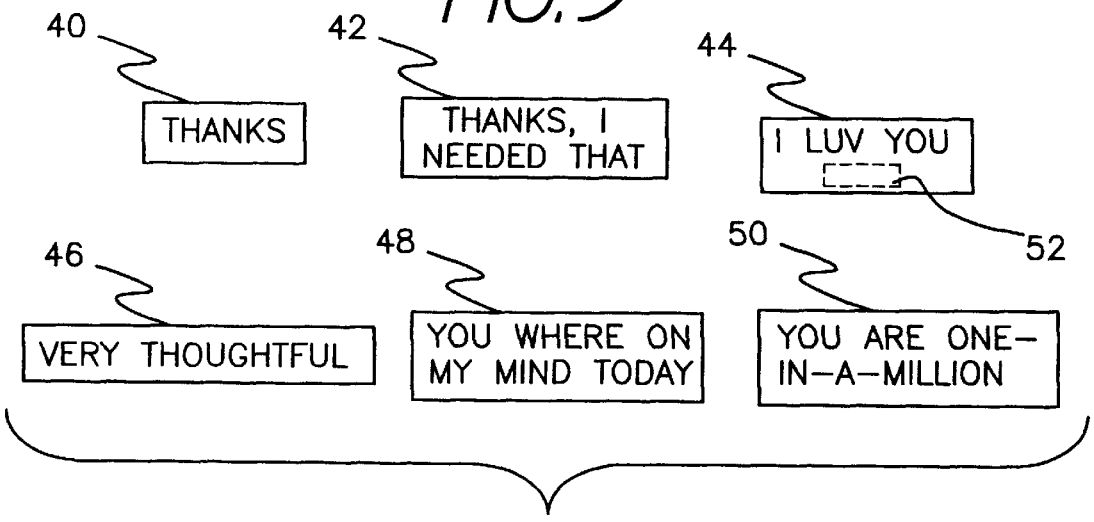
FIG. 4 shows various information conveying messages that may be used as moveable elements.

In addition to masks 16, 18, 20, 34, 36, and 38, information conveying members 40, 42, 44, 46, 48, and 50 may be posted on panel 12. An information conveying member 40, 42, 44, 46, 48, or 50 bears message indicia corresponding to information conveyed in written language, and includes a magnet 52 or other means of adhering which are similar to those employed for masks 16, 18, 20, 34, 36, and 38. Such messages will generally express sentiments ancillary to the primary message conveyed by a mask 16, 18, 20, 34, 36, or 38. Actual messages may be among the examples shown in FIG. 4.

The present invention is susceptible to variations and modifications which may be introduced without departing from the inventive concept. For example, the messages and sentiments conveyed by masks 16, 18, 20, 34, 36, and 38 and information conveying members 40, 42, 44, 46, 48, and 50 may vary from the examples shown. Actual pictorial representations may similarly vary. The time display could be numerical, with removable or resettable digits (not shown), if desired.

It is to be understood that the present invention is not limited to the embodiments described above, but encompasses any and all embodiments within the scope of the following claims.

I claim:

1. A message calendar having:

a principal panel bearing date indicia corresponding to the days of a year sequentially numbered for each month, a clock face having movable, passive hands for annunciating a preferred time of the day for engaging in an activity, and frontal surface area devoid of date indicia, said area devoid of date indicia dimensioned and configured for temporarily storing a plurality of objects by adhering said plurality of objects thereto;

a plurality of masks having means for removably adhering to said principal panel of said message calendar and an opening therein, said opening dimensioned and configured to reveal date indicia corresponding to one day of the month and to conceal adjacent and contiguous date indicia, said mask bearing a pictorial device configured to evoke a symbol of one of a human activity and a human sentiment, for indicating a suggested day to engage in the activity symbolized by said mask, said masks including a first mask bearing a pictorial representation of a turtle, for suggesting an activity conducted in a prolonged and leisurely pace, a second mask bearing a pictorial representation of a rabbit, for suggesting an activity conducted expeditiously, a third mask bearing a pictorial representation of an analgesic medicament, for expressing a desire to defer a suggested activity due to incapacitation by physiological distress, and a fourth mask bearing a pictorial representation of wine glasses being raised in a toast, for expressing a desire to engage in a celebratory activity; and a plurality of information conveying members bearing message indicia corresponding to information conveyed in written language, said information conveying members each having means for removably adhering to said principal panel of said message calendar.

* * * * *